US009528514B2

(12) United States Patent
Shimaguchi et al.

(10) Patent No.: US 9,528,514 B2
(45) Date of Patent: Dec. 27, 2016

(54) GAS COMPRESSOR HAVING AN ASYMMETRIC CYLINDER CHAMBER

(71) Applicant: CALSONIC KANSEI CORPORATION, Saitama (JP)

(72) Inventors: Hirotada Shimaguchi, Saitama (JP); Kouji Hirono, Saitama (JP); Masahiro Tsuda, Saitama (JP); Tatsuya Osaki, Saitama (JP); Shizuma Kaneko, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 43 days.

(21) Appl. No.: 14/389,871

(22) PCT Filed: Mar. 28, 2013

(86) PCT No.: PCT/JP2013/059385
§ 371 (c)(1),
(2) Date: Oct. 1, 2014

(87) PCT Pub. No.: WO2013/150967
PCT Pub. Date: Oct. 10, 2013

(65) Prior Publication Data

US 2015/0064042 A1 Mar. 5, 2015

(30) Foreign Application Priority Data

Apr. 2, 2012 (JP) ..... 2012-084082

(51) Int. Cl.
*F03C 2/00* (2006.01)
*F03C 4/00* (2006.01)
(Continued)

(52) U.S. Cl.
CPC ..... *F04C 2/344* (2013.01); *F01C 21/106* (2013.01); *F04C 15/064* (2013.01);
(Continued)

(58) Field of Classification Search
CPC ..... F04C 2/344; F04C 2/3441; F04C 18/344; F04C 18/3441; F04C 28/10; F04C 29/0035; F04C 2250/30; F04C 2250/102; F04C 15/064; F01C 21/106
(Continued)

(56) References Cited

U.S. PATENT DOCUMENTS 4,279,578 A * 7/1981 Kim ..... F04C 28/28 418/97
2006/0073033 A1 4/2006 Sundheim
2008/0304474 A1 12/2008 Lam

FOREIGN PATENT DOCUMENTS

CN 101639069 2/2010
JP 51-2015 1/1976
(Continued)

OTHER PUBLICATIONS

JP 2002250288A—Kanesugi et al. , Vane Type Compressor—Sep. 6, 2002—English Translation.*
(Continued)

*Primary Examiner* — Theresa Trieu
(74) *Attorney, Agent, or Firm* — Wenderoth, Lind & Ponack, L.L.P.

(57) ABSTRACT

In a gas compressor, an outline shape of an inner peripheral surface (41) of a cylinder (40) is set such that in a point before a first compression chamber (43B) adjacent to a second compression chamber (43A) in an upstream side in a rotational direction (W) is exposed to a discharge hole (45*b*) of a primary discharge portion (45) with rotation of a rotor (50) in the rotational direction (W) (point where the first compression chamber (43B) is positioned upstream of an angular position of being exposed to the discharge hole (45*b*) of the primary discharge portion (45)), a pressure of refrigerant gas (G) inside the compression chamber (43) reaches a discharge pressure. Therefore, the discharge hole
(Continued)

(45*b*) of the primary discharge portion (45) always discharges the refrigerant gas (G) from the compression chamber (43).

8 Claims, 3 Drawing Sheets

(51) Int. Cl.

| | |
|---|---|
| ***F04C 2/00*** | (2006.01) |
| ***F04C 2/344*** | (2006.01) |
| ***F01C 21/10*** | (2006.01) |
| ***F04C 29/00*** | (2006.01) |
| ***F04C 18/344*** | (2006.01) |
| ***F04C 15/06*** | (2006.01) |
| ***F04C 28/10*** | (2006.01) |

(52) U.S. Cl.
CPC ..... *F04C 18/3441* (2013.01); *F04C 28/10* (2013.01); *F04C 29/0035* (2013.01); *F04C 2250/102* (2013.01); *F04C 2250/30* (2013.01)

(58) Field of Classification Search
USPC ..... 418/15, 259, 270, DIG. 1, 133
See application file for complete search history.

(56) References Cited

FOREIGN PATENT DOCUMENTS

| | | | | |
|---|---|---|---|---|
| JP | 54-28008 | | 3/1979 | |
| JP | 56-54986 | | 5/1981 | |
| JP | 56-150886 | | 11/1981 | |
| JP | 2002250288 A | * | 9/2002 | ..... F04C 2/344 |
| JP | 2008-513676 | | 5/2008 | |
| WO | 2006/036598 | | 4/2006 | |

OTHER PUBLICATIONS

International Search Report (ISR) issued Jun. 25, 2013 in International (PCT) Application No. PCT/JP2013/059385.

* cited by examiner

GAS COMPRESSOR HAVING AN ASYMMETRIC CYLINDER CHAMBER

CROSS-REFERENCE TO RELATED APPLICATION

This application claims priority under 35 U.S.C. §119 from Japanese Patent Application No. 2012-084082 filed on Apr. 2, 2012, the disclosure of which is herein incorporated by reference.

BACKGROUND OF THE INVENTION

1. Technical Field

The present invention relates to a gas compressor, and in particular, to an improvement in a gas compressor of a vane rotary type.

2. Background Art

An air conditioning system conventionally uses a gas compressor that compresses a gas such as a refrigerant gas to be circulated in the air conditioning system.

The gas compressor is configured such that a compressor body that is driven for rotation to compress the gas is accommodated in a housing, a discharge chamber to which a high-pressure gas is discharged from the compressor body is defined to be formed, and the high-pressure gas is discharged from the discharge chamber to an outside of the housing.

A so-called vane rotary type gas compressor is known as an example of this gas compressor.

The gas compressor of this vane rotary type is configured such that a compressor body is accommodated inside the housing, wherein the compressor body includes a substantially columnar rotor that rotates together with a rotary shaft, a cylinder having an inner peripheral surface of an outline shape for surrounding the rotor from an outside of a peripheral surface thereof, a plurality of plate-shaped vanes provided to be able to project outward from the peripheral surface of the rotor, bearings that rotatably support the rotary shaft projecting from both end surfaces of the rotor, and side blocks that make contact with both end surfaces of the rotor and the cylinder to close both of the end surfaces, wherein a cylinder chamber is a space that is formed by an outer peripheral surface of the rotor, an inner peripheral surface of the cylinder and each inside surface of both of the side blocks for suction, compression and discharge of a gas.

The cylinder chamber, by configuring a projecting-side front end of each vane projecting from the outer peripheral surface of the rotor to be in contact with the inner peripheral surface of the cylinder, is defined into a plurality of compression chambers with the outer peripheral surface of the rotor, the inner peripheral surface of the cylinder and each inside surface of both of the side blocks, and the two vanes in tandem along a rotational direction of the rotor.

The outline shape of the inner peripheral surface of the cylinder is set such that an interval between the outer peripheral surface of the rotor and the inner peripheral surface of the cylinder changes for each rotary angle position of the rotor.

Specifically, the above-mentioned interval changes to be rapidly large from a small state in the upstream side in the rotational direction of the rotor, which corresponds to a stroke in which a volume of the compression chamber is enlarged with rotation of the rotor for the gas to be suctioned into the compression chamber through a suction portion.

Next, the interval is set in such a manner as to become gradually smaller toward the downstream side in the rotational direction of the rotor, which corresponds to a stroke in which a volume of the compression chamber decreases with rotation of the rotor for the gas in the compression chamber to be compressed.

Further, the interval is set to be further smaller in the downstream side in the rotational direction of the rotor, which corresponds to a stroke in which the gas compressed in the compression chamber with rotation of the rotor is discharged outside of the compression chamber through a discharge portion, and repetition of the suction stroke, the compression stroke, and the discharge stroke in this order enables a low-pressure gas suctioned from an outside of the compression chamber to be changed to a high-pressure gas for discharge (Japanese Patent Application Publication No. 54-28008).

Technical Problem

However, the gas compressor of the vane rotary type has a tendency such that an efficiency (Coefficient of Performance or COP: Cooling capacity/power) is lower than gas compressors of other types due to some factors; for example, since the gas is rapidly compressed, excess compression tends to be easily generated in the compression chamber, and losses of power become larger or a difference in pressure between adjacent compression chambers becomes large, and therefore the gas is easily leaked from the compression chamber in the downstream side of the rotational direction to the compression chamber in the upstream side of the rotational direction.

Such a tendency toward low efficiency becomes disadvantageous, in particular at the operating of a high-speed rotation of the gas compressor.

SUMMARY OF THE INVENTION

The present invention is made in view of the foregoing problems, and an object of the present invention is to provide a gas compressor that can appropriately prevent excessive compression in a compression chamber.

Solution to Problem

A gas compressor according to the present invention is configured such that, when a compression chamber reaches a discharge pressure that causes excessive compression in a point before the compression chamber is exposed to a discharge portion (hereinafter, referred to as "primary discharge portion") for discharging a compressed gas from the compression chamber, since the compression chamber is exposed to another discharge portion (hereinafter, referred to as "secondary discharge portion") provided closer to the upstream side in the rotational direction of the rotor than the primary discharge portion, the gas of the discharge pressure in the compression chamber is discharged outside from the compression chamber through the secondary discharge portion, appropriately preventing the gas in the compression chamber from being excessively compressed.

In addition, a gas compressor according to the present invention is configured such that, since a compression chamber reaches a discharge pressure in a point before the compression chamber is exposed to a primary discharge portion, a gas continues to be discharged from the compression chamber exposed to the primary discharge chamber to the primary discharge portion over an entire period from a point where the compression chamber reaches the primary discharge portion to a point where the compression chamber passes over the primary discharge portion. Therefore, occurrence of discharge pulsation to be generated downstream of the discharge portion caused by interruption of the discharge of the gas into the primary discharge portion can be prevented to prevent occurrence of abnormal noises or the like by the discharge pulsation.

It should be noted that, at the moment when a vane partitioning between the compression chambers passes through the primary discharge portion, since any one of the compression chambers is not exposed to the primary discharge portion, there may possibly occur the event that the gas is not discharged to the primary discharge portion for that moment only.

However, since a magnitude (length) of an opening in the primary discharge portion in the rotational direction is regularly larger than the thickness of the vane partitioning between the compression chambers, at least one of the two compression chambers in tandem in the rotational direction that are partitioned by the vane is in a state of being exposed to at least a part of the opening in the primary discharge portion without fail during a period when the vane passes through the primary discharge portion. Therefore, as long as the thickness of the vane and the magnitude of the opening in the primary discharge portion are set to the aforementioned regular sizes, the discharge of the gas to the primary discharge portion is not interrupted.

That is, a gas compressor according to the present invention is configured to accommodate a compressor body inside a housing, the compressor body including a substantially columnar rotor that rotates integrally with a rotary shaft, a cylinder that has an inner peripheral surface of an outline shape for surrounding the rotor from an outside of an outer peripheral surface of the rotor, and is provided with a discharge portion for, when a pressure of the gas inside the compression chamber exposed to the inner peripheral surface reaches a discharge pressure, discharging the gas inside the compression chamber, a plurality of plate-shaped vanes provided to project from the outer peripheral surface of the rotor to the inner peripheral surface of the cylinder, and two side blocks that close both ends of the rotor and the cylinder, wherein: the vanes partition a space formed between the inner peripheral surface of the cylinder and the outer peripheral surface of the rotor to form a plurality of compression chambers, the outline shape of the inner peripheral surface of the cylinder is set such that each compression chamber performs suction and compression of the gas, and discharge of the gas from the discharge portion by only one cycle during a period of one rotation of the rotor and a pressure of the gas inside the compression chamber reaches the discharge pressure in a point before the compression chamber is exposed to the discharge portion with rotation of the rotor, and at least one secondary discharge portion is formed in the upstream side of the discharge portion in the rotational direction of the rotor to discharge the gas inside the compression chamber when the pressure of the gas inside the compression chamber reaches the discharge pressure.

Advantageous Effects of Invention

The gas compressor according to the present invention can appropriately prevent excessive compression in the compression chamber.

In addition, the gas compressor according to the present invention can prevent discharge pulsations to be generated downstream of the discharge portion from occurring to prevent occurrence of abnormal noises or the like due to the discharge pulsations.

It should be noted that the gas compressor according to the present invention, since suction and compression of the gas, and discharge of the gas from the discharge portion are performed by only one cycle during a period of one rotation of the rotor, can gradually compress the gas to reduce necessary power.

DESCRIPTION OF THE EMBODIMENTS

Hereinafter, an explanation will be made in detail of a specific embodiment of a gas compressor according to the present invention with reference to the accompanying drawings.

An electric vane rotary compressor 100 (hereinafter, simply referred to as "compressor 100") that is an embodiment of a gas compressor according to the present invention is used as a gas compressor in an air conditioning system having an evaporator, a gas compressor, a condenser and an expansion valve that are installed in an automobile or the like. An operating medium of the air conditioning system is a refrigerant gas G (gas).

Figure 1:
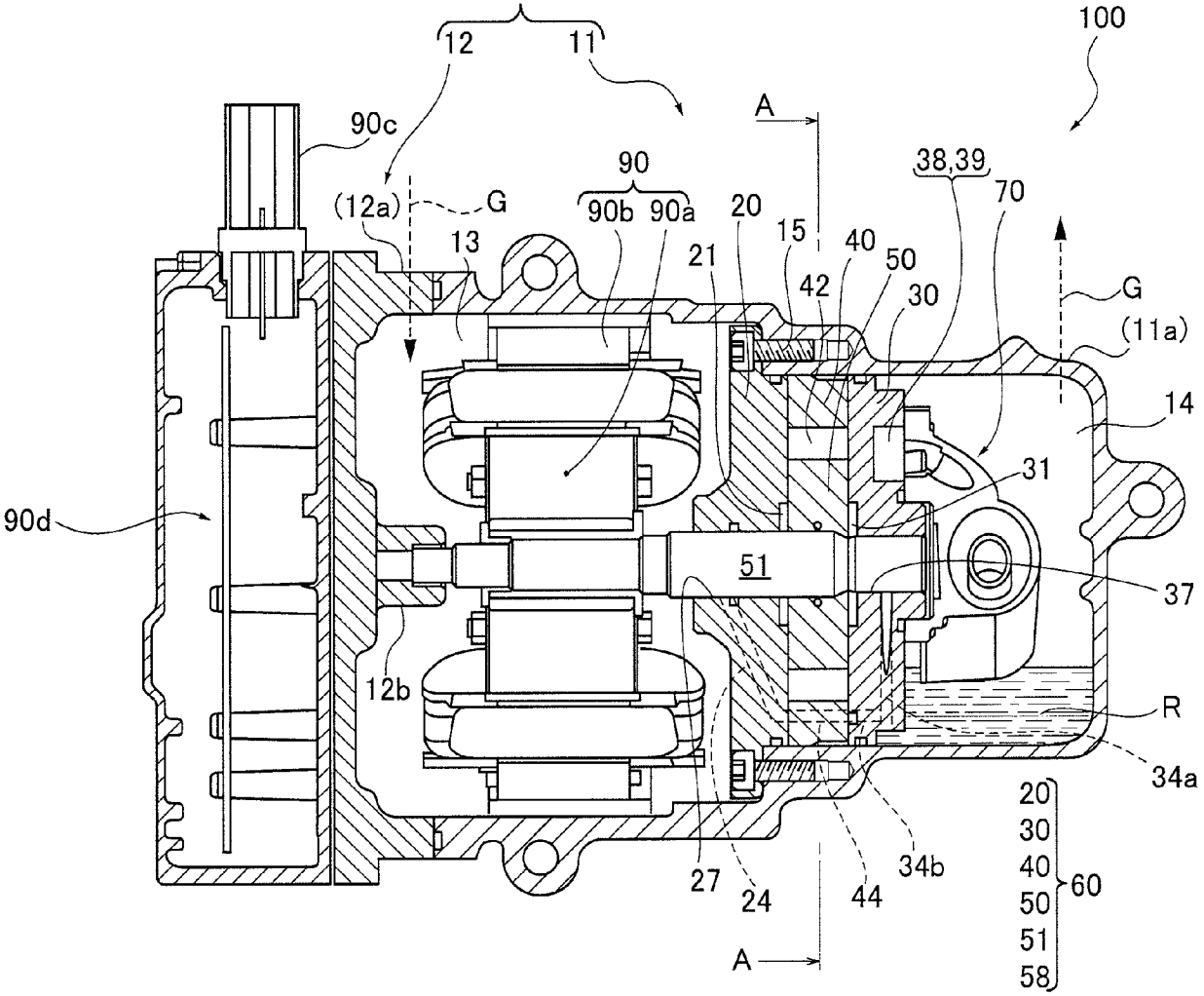
FIG. 1 is a transverse cross section of a vane rotary compressor that is an embodiment of a gas compressor according to the present invention.

The compressor 100 is, as shown in FIG. 1, structured such that a motor 90 and a compressor body 60 are accommodated inside a housing 10 configured primarily of a body case 11 and a front cover 12.

The body case 11 is formed in a substantially cylindrical shape, wherein one of the ends of the cylindrical shape is formed to be closed and the other end is formed to be open.

The front cover 12 is formed in a lid shape to close the opening of the body case 11 in a state of being in contact with the end of the body case 11 in the opening side, and is fastened to the body case 11 by a fastening member in this state to be integral with the body case 11, thus forming the housing 10 having a space therein.

The front cover 12 is provided with a suction port 12*a* that establishes communication between an inside and an outside of the housing 10 to introduce a low-pressure refrigerant gas G from the evaporator in the air conditioning system inside the housing 10.

On the other hand, the body case 11 is provided with a discharge port 11*a* that establishes communication between the inside and the outside of the housing 10 to discharge a high-pressure refrigerant gas G from the inside of the housing 10 to the evaporator in the air conditioning system.

The motor 90 that is provided inside the body case 11 forms part of a multiple-phase brushless DC motor equipped with a rotor 90*a* of a permanent magnet and a stator 90*b* of an electromagnet.

The stator 90*b* is fitted in an inner peripheral surface of the body case 11 for fixation, and a rotary shaft 51 is fixed to the rotor 90*a*.

The motor 90 drives and rotates the rotor 90*a* and the rotary shaft 51 around an axis thereof by exciting the electromagnet of the stator 90*b* with power supplied through a power source connector 90*c* mounted on the front cover 12.

It should be noted that there may be adopted a configuration in which an inverter circuit 90*d* is provided between the power source connector 90*c* and the stator 90*b*.

The compressor 100 according to the present embodiment is of an electric type as described above, but the gas compressor according to the present invention is not limited to the electric type, and may be of a mechanical type. Assuming that the compressor 100 according to the present embodiment is of a mechanical type, instead of being provided with the motor 90, the rotary shaft 51 may be configured to project outside from the front cover 12, wherein a pulley, a gear and the like, receiving transmission of power from an engine of a vehicle or the like, are provided in a front end of the projecting rotary shaft 51.

The compressor body 60 accommodated inside the housing 10 together with the motor 90 is arranged side-by-side with the motor 90 along a direction where the rotary shaft 51 extends, and is fixed to the body case 11 by a fastening member 15 such as a bolt.

The compressor body 60 includes the rotary shaft 51 that is rotated by the motor 90, the substantially columnar rotor 50 that rotates integrally with the rotary shaft 51, the cylinder 40 having the inner peripheral surface 41 in the outline shape for surrounding the rotor 50 from the outside of the outer peripheral surface 52 (refer to FIG. 2), five plate-shaped vanes 58 that are provided to be able to project from the outer peripheral surface 52 of the rotor 50 to the inner peripheral surface 41 of the cylinder 40, and two side blocks (front side block 20 and rear side block 30) that close both ends of the rotor 50 and the cylinder 40.

Here, the rotary shaft 51 is rotatably supported by a bearing 12*b* formed in the front cover 12 and bearings 27 and 37 formed in the respective side blocks 20, 30 of the compressor body 60.

The compressor body 60 partitions the space inside the housing 10 into left and right spaces to have the compressor body 60 therebetween, as shown in FIG. 1.

In addition, a sealing member such as an O-ring is provided on each of the outer peripheral surfaces of both the side blocks 20, 30 over the entire periphery of the outer peripheral surface, and contact of the sealing members with the entire periphery of the inner peripheral surface of the body case 11 holds air tightly between the left and right spaces having the compressor body 60 therebetween as shown in FIG. 1.

The left space in FIG. 1 of the two spaces partitioned inside the housing 10 across the compressor body 60 is a suction chamber 13 in a low-pressure atmosphere into which a low-pressure refrigerant gas G is introduced from the evaporator through a suction port 12*a*, and the right space in FIG. 1 across the compressor body 60 is a discharge chamber 14 in a high-pressure atmosphere into which a high-pressure refrigerant gas G is discharged to the evaporator through a discharge port 11*a*.

Figure 2:
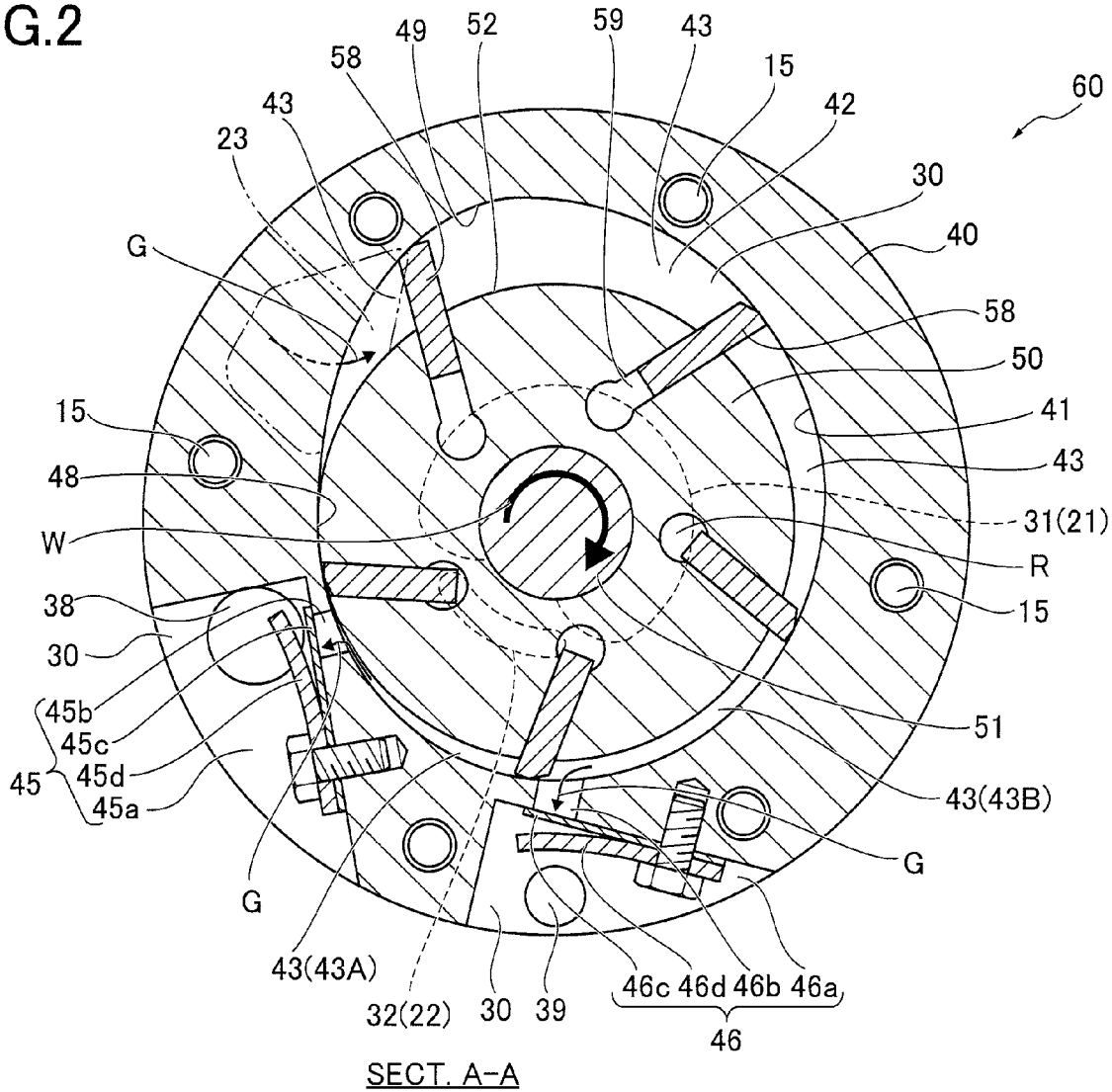
FIG. 2 is a cross section taken along line A-A of a compressor portion in the vane rotary compressor shown in FIG. 1.

A single cylinder chamber 42 in a substantially C-letter shape is, as shown in FIG. 2, formed inside the compressor body 60 to be surrounded by the inner peripheral surface 41 of the cylinder 40, the outer peripheral surface 52 of the rotor 50, and both of the side blocks 20, 30.

Specifically the outline shape of the inner peripheral surface 41 of the cylinder 40 is set such that the inner peripheral surface 41 of the cylinder 40 and the outer peripheral surface 52 of the rotor 50 come close only at one location within a range of one loop around the axis of the rotary shaft 51 (angle of 360 degrees), and thereby the cylinder chamber 42 is formed as a single space.

It should be noted that a proximal portion 48, which is formed as a section in which the inner peripheral surface 41 of the cylinder 40 and the outer peripheral surface 52 of the rotor 50 come the closest, of the outline shape of the inner peripheral surface 41 of the cylinder 40 is formed in a position away, by an angle of 270 degrees to less than 360 degrees downstream along a rotational direction W (clockwise direction in FIG. 2) of the rotor 50, from a remote portion 49 formed as a section in which the inner peripheral surface 41 of the cylinder 40 and the outer peripheral surface 52 of the rotor 50 are the furthest apart.

The outline shape of the inner peripheral surface 41 of the cylinder 40 is set in such a shape that a distance between the outer peripheral surface 52 of the rotor 50 and the inner peripheral surface 41 of the cylinder 40 gradually reduces from the remote portion 49 to the proximal portion 48 along the rotational direction W.

The vane 58 is fitted in a vane groove 59 formed in the rotor 50, and projects outward from the outer peripheral surface 52 of the rotor 50 by a back pressure caused by refrigerant oil R supplied to the vane groove 59.

The vane 58 partitions the single cylinder chamber 42 into a plurality of compression chambers 43, and one compression chamber 43 is formed by the two vanes 58 in tandem along the rotational direction W of the rotor 50. Therefore, five compression chambers 43 are formed in the present embodiment in which five vanes 58 are installed at equal angular intervals, each having an angle of 72 degrees around the rotary shaft 51.

However, since the compression chamber 43 is partitioned by the proximal portion 48 and the one vane 58 in the upstream end or the downstream end of the cylinder chamber 42, six compression chambers 43 are formed in a large part of the period during the rotating of the rotor 50, and only when the vane 58 passes the proximal portion 48, there exists a period where five compression chambers 43 are formed.

A volume inside the compression chamber 43 obtained by partitioning the cylinder chamber 42 with the vanes 58 is gradually reduced until the compression chamber 43 reaches from the remote portion 49 to the proximal portion 48 along the rotational direction W.

A suction hole 23 that is formed in the front side block 20 to communicate with a suction chamber 13 is exposed to the upstream part of the cylinder chamber 42 in the rotational direction W of the rotor 50.

On the other hand, two discharge holes 45*b*, 46*b* that are formed in the cylinder 40 to individually communicate with two discharge portions 45, 46 are respectively exposed to the downstream part of the cylinder chamber 42 in the rotational direction W of the rotor 50.

The outline shape of the inner peripheral surface 41 of the cylinder 40 is provided such that each compression chamber 43 performs suction of the refrigerant gas compression of the refrigerant gas and discharge of the refrigerant gas G to the discharge portions 45, 46 through the discharge hole 45*b* or 46*b* by only one cycle during a period of one rotation of the rotor 50.

The outline shape of the inner peripheral surface 41 is formed in the upstream side in the rotational direction W of the rotor 50 such that an interval between the inner peripheral surface 41 of the cylinder 40 and the outer peripheral surface 52 of the rotor 50 rapidly increases from a small state to a large state, and within an angular range including the remote portion 49, the volume of the compression chamber 43 increases with rotation of the rotor 50 in the rotational direction W to form a stroke (suction stroke) in which the refrigerant gas G is suctioned into the compression chamber 43 through the suction hole 23.

Subsequently, the outline shape of the inner peripheral surface 41 is provided such that the interval between the inner peripheral surface 41 of the cylinder 40 and the outer peripheral surface 52 of the rotor 50 is gradually reduced toward the downstream side in the rotational direction W of the rotor 50, and, within that range, the volume of the compression chamber 43 decreases with rotation of the rotor 50 to form a stroke (compression stroke) in which the refrigerant gas G in the compression chamber 43 is compressed.

The interval between the inner peripheral surface 41 of the cylinder 40 and the outer peripheral surface 52 of the rotor 50 is further reduced in the further downstream side of the rotational direction W of the rotor 50 for the compression of the refrigerant gas G to be further performed, and when a pressure of the refrigerant gas G reaches a predetermined discharge pressure, a stroke (discharge stroke) in which the refrigerant gas G is discharged to the discharge portions 45, 46, through the discharge holes 45*b*, 46*b* is formed which will be described later.

With rotation of the rotor 50, each compression chamber 43 repeats the suction stroke, the compression stroke and the discharge stroke in that order, and thereby the low-pressure refrigerant gas G suctioned from the suction chamber 13 is changed to a high-pressure refrigerant gas which is discharged from the compressor body 60.

The respective discharge portions 45, 46 include spaces (hereinafter, referred to as "discharge chambers 45*a*, 46*a*") surrounded by the cylinder 40, both of the side blocks 20, 30, and the body case 11, the discharge holes 45*b*, 46*b* establishing communication between the discharge chambers 45*a*, 46*a* and the compression chambers 43, discharge valves 45*c*, 46*c*, each of which is flexibly deformed to deflect to a side of one of the discharge chambers 45*a*, 46*a* due to a difference in pressure between both the pressures when a pressure of the refrigerant gas G in the compression chamber 43 is equal to or more than a pressure (discharge pressure) in each of the discharge chambers 45*a*, 46*a*, to open each of the discharge holes 45*b*, 46*b*, and close each of the discharge holes 45*b*, 46*b* with resilient force when the pressure of the refrigerant gas G in the compression chamber 43 is less than the pressure (discharge pressure) in each of the discharge chambers 45*a*, 46*a*, and valve supports 45*d*, 46*d* that prevent excessive deflection of the discharge valves 45*c*, 46*c* to the sides of the discharge chambers 45*a*, 46*a*.

It should be noted that the discharge chamber 45*a* of the discharge portion that is one of the two discharge portions 45, 46, which is provided in the downstream side in the rotational direction W of the rotor 50, that is, the discharge portion 45 closer to the proximal portion 48 communicates with a cyclone block 70 mounted on an outer surface (surface directed to a discharge chamber 14) of the rear side block 30 through a discharge passage 38 formed in the rear side block 30.

Similarly, the discharge chamber 46*a* of the discharge portion that is one of the two discharge portions 45, 46, which is provided in the upstream side in the rotational direction W of the rotor 50, that is, the discharge portion 46 farther from the proximal portion 48 communicates with the cyclone block 70 through a discharge passage 39 formed in the rear side block 30.

The cyclone block 70 acts to separate the refrigerant oil R mixed with the refrigerant gas G from the refrigerant gas and spirally revolves the refrigerant gas G that is discharged to the respective discharge chambers 45*a*, 46*a* and is introduced through the discharge passages 38, 39 to separate the refrigerant oil R from the refrigerant gas G by centrifugation.

The refrigerant oil R separated from the refrigerant gas G accumulates in the bottom part in the discharge chamber 14, and the high-pressure refrigerant gas G from which the refrigerant oil R has been separated is discharged into the discharge chamber 14, and thereafter, is discharged to the evaporator through the discharge port 11*a*.

The refrigerant oil R accumulated in the bottom part of the discharge chamber 14 is supplied to vane grooves 59 of the rotor 50 through an oil passage 34*a* formed in the rear side block 30 and sweep grooves 31, 32 that are recessed portions for backpressure supply formed in the rear side block 30, and through oil passages 34*a*, 34*b* formed in the rear side block 30, an oil passage 44 formed in the cylinder 40, an oil passage 24 formed in the front side block 20 and sweep grooves 21, 22 that are recessed portions for backpressure supply formed in the front side block 20 by a high-pressure atmosphere in the discharge chamber 14, becoming a backpressure for protruding the vane 58 outward.

It should be noted that the refrigerant oil R leaks out from a gap between the vane 58 and the vane groove 59, a gap between the rotor 50 and the side blocks 20, 30, and the like to perform functions of lubrication or cooling in contact portions between the rotor 50 and both of the side blocks 20, 30, contact portions between the vane 58 and the cylinder 40, contact portions between the vane 58 and both of the side blocks 20, 30, and the like, and since a part of the refrigerant oil R is mixed with the refrigerant gas G in the compression chamber 43, separation of the refrigerant oil R is performed by the cyclone block 70.

The refrigerant oil R to be supplied to the sweep groove 31, which is formed in the upstream part in the rotational direction W of the rotor 50 (part corresponding to the suction stroke and the compression stroke), of the two sweep grooves 31, 32 formed in the rear side block 30 is supplied to the sweep groove 31 through a narrow gap between the bearing 37 and the outer peripheral surface of the rotary shaft 51 from the oil passage 34*a*. Therefore, the refrigerant oil R becomes an intermediate pressure (pressure higher than the suction pressure that is the atmosphere in the suction chamber 13) that is lower than a high pressure (pressure close to the discharge pressure) that is the atmosphere in the discharge chamber 14 due to pressure losses at the time of passing the narrow gap between the bearing 37 and the outer peripheral surface of the rotary shaft 51.

The refrigerant oil R to be supplied to the sweep groove 21, which is formed in the upstream part in the rotational direction W of the rotor 50, of the two sweep grooves 21, 22 formed in the front side block 20 also becomes an intermediate pressure similar to the refrigerant oil R to be supplied to the sweep groove 31.

On the other hand, the sweep groove 32, which is formed in the downstream part in the rotational direction W of the rotor 50 (part corresponding primarily to the discharge stroke), of the two sweep grooves 31, 32 is connected to the oil passage 34*a* without pressure losses, and the refrigerant oil R is supplied from the oil passage 34*a* to the sweep groove 32 without pressure losses. Therefore, the refrigerant oil R becomes a pressure (pressure higher than the intermediate pressure) close to the high pressure that is the atmosphere in the discharge chamber 14.

The sweep groove 22, which is formed in the downstream part in the rotational direction W of the rotor 50, of the two sweep grooves 21, 22 is also connected to the oil passage 24 without pressure losses, and therefore, the refrigerant oil R becomes a high pressure similar to the refrigerant oil R to be supplied to the sweep groove 32.

When the vane groove 59 that has penetrated to both of the end surfaces of the rotor 50 communicates with each of the sweep grooves 21, 31, 22, 32 of each of the side blocks 20, 30 with rotation of the rotor 50, the refrigerant oil R is supplied to the vane groove 59 from each of the communicated sweep grooves 21, 31, 22, 32, and a pressure of the supplied refrigerant oil R becomes a backpressure for protruding the vane 58.

Next, an explanation will be made in detail of the two discharge portions 45, 46 in the compressor 100 according to the present embodiment.

First, the discharge portion 45 formed in the upstream side immediately before the proximal portion 48 along the rotational direction W of the rotor 50 corresponds to an original single discharge portion in the gas compressor configured to be provided only with the single discharge portion and perform the compression cycle composed of suction, compression and discharge for every one rotation of the rotor 50 by only one cycle, and can be a primary discharge portion.

Therefore, for clarifying the distinction between the primary discharge portion 45 and the secondary discharge portion 46 in the following explanation, there are some cases where the discharge portion 45 is referred to as the primary discharge portion 45, and the discharge portion 46 formed upstream of the primary discharge portion 45 in the rotational direction W is referred to as the secondary discharge portion 46.

The primary discharge portion 45 is configured such that when a pressure of the refrigerant gas G inside the compression chamber 43 (when it is necessary to distinguish this compression chamber 43 from the other compression chamber 43, it is referred to as a compression chamber 43A) exposed to the discharge hole 45*b* of the primary discharge portion 45 becomes a high pressure equal to or more than the pressure (discharge pressure) in the discharge chamber 45*a* by action of the discharge valve 45*c* as described above, the refrigerant gas G in the compression chamber 43 is discharged to the discharge chamber 45*a* through the discharge hole 45*b*.

Here, in the compressor 100 according to the present embodiment, the outline shape of the inner peripheral surface 41 of the cylinder 40 is set such that in a point (point where the compression chamber 43 is positioned upstream of an angular position exposed to the discharge hole 45*b* of the primary discharge portion 45) before the compression chamber 43 (when it is necessary to distinguish this compression chamber 43 from the other compression chamber 43, it is referred to as a compression chamber 43B) adjacent to the compression chamber 43A in the upstream side in the rotational direction W (when it is necessary to distinguish this compression chamber 43 from the other compression chamber 43, it is referred to as a compression chamber 43A) is exposed to the discharge hole 45*b* of the primary discharge portion 45 with rotation of the rotor 50 in the rotational direction W, a pressure of the refrigerant gas G inside the compression chamber 43 reaches the discharge pressure.

In the compressor 100 according to the present embodiment, when the pressure of the refrigerant gas G inside the compression chamber 43B reaches the discharge pressure in a point before the compression chamber 43B is exposed to the discharge hole 45*b* of the primary discharge portion 45, since the secondary discharge portion 46 that discharges the refrigerant gas G inside the compression chamber 43B outside of the compression chamber 43B is provided in the upstream side of the primary discharge portion 45 in the rotational direction W of the rotor 50, when the pressure of the refrigerant gas G inside the compression chamber 43B reaches the discharge pressure in a point before the compression chamber 43B is exposed to the discharge hole 45*b* of the primary discharge portion 45, the refrigerant gas G inside the compression chamber 43B is discharged to the discharge chamber 46*a* through the discharge hole 46*b* of the secondary discharge portion 46, thus making it possible to appropriately prevent excessive compression in which the refrigerant gas G exceeds the discharge pressure in a point before the compression chamber 43B reaches the discharge hole 45*b* of the primary discharge portion 45.

That is, assuming that only one discharge portion (only primary discharge portion 45) is formed in the gas compressor, since the volume of the compression chamber 43B is further reduced with further rotation of the rotor 50, the pressure of the refrigerant gas G inside the compression chamber 43B exceeds the discharge pressure, but the refrigerant gas G having exceeded the discharge pressure is not discharged before the rotor 50 rotates to a position in which the compression chamber 43B is exposed to the discharge hole 45*b* of the primary discharge portion 45. Therefore, the excessive compression is generated in the compression chamber 43, and when a load for pushing back the vane 58 in the upstream side in the rotational direction W of the two vanes 58, 58 partitioning the compression chamber 43B at the front end side from the cylinder 40 exceeds a pushing load of the vane 58 to the cylinder 40 by a combined force of a force acting on the vane 58 by the refrigerant oil R of the vane groove 59 and a centrifugal force acting on the vane 58, there occurs chattering that a projecting-side front end of the vane 58 is momentarily separated from the inner peripheral surface 41 of the cylinder 40. However, according to the compressor 100 in the present embodiment, since the excessive compression is prevented, the vane 58 partitioning the compression chamber 43B does not generate the chattering, and no loss of the internal pressure in the compression chamber 43B occurs.

In addition, in the compressor 100 according to the present embodiment, since the pressure of the refrigerant gas G inside the compression chamber 43 reaches the discharge pressure in a point before the compression chamber 43 is exposed to the discharge hole 45*b* of the primary discharge portion 45, the refrigerant gas G inside the compression chamber 43 is discharged to the cyclone block 70 from the discharge hole 46*b* of the secondary discharge portion 46 through the discharge chamber 46*a* and the discharge passage 39, but when the compression chamber 43 exposed to the secondary discharge portion 46 advances in the downstream side with rotation of the rotor 50, and is finally exposed to the discharge hole 45*b* of the primary discharge portion 45, the refrigerant gas G inside the compression chamber 43B continues to be discharged from the compression chamber 43 through the discharge hole 45*b* of the primary discharge portion 45 over the entire period for which the compression chamber 43 is exposed to the discharge hole 45*b* of the primary discharge portion 45.

That is, even if the refrigerant gas G is discharged from the compression chamber 43 through the discharge hole 46*b* of the secondary discharge portion 46 in the period where the compression chamber 43 is exposed to the discharge hole 46*b* of the secondary discharge portion 46, the volume of the compression chamber 43 is reduced further from a state of being exposed to the secondary discharge portion 46 with rotation of the rotor 50. Therefore, a pressure of the refrigerant gas G inside the compression chamber 43 is the discharge pressure or more also in a point where the compression chamber 43 is exposed to the discharge hole 45*b* of the primary discharge portion 45.

Since the volume of the compression chamber 43 is gradually reduced over the entire period from a first point where the compression chamber 43 starts to be exposed to the discharge hole 45*b* of the primary discharge portion 45 to a final point where the compression chamber 43 ends in passing the discharge hole 45*b* of the primary discharge portion 45, the refrigerant gas G inside the compression chamber 43 continues to be discharged from the compression chamber 43 through the discharge hole 45*b* of the primary discharge portion 45 over the entire period.

As described above, the compression chamber 43 reaches the discharge pressure over the entire period of being exposed to the discharge hole 45*b* of the primary discharge portion 45, but this is applied to all the compression chambers 43 in the same way, and therefore, the discharge hole 45*b* of the primary discharge portion 45 results in always discharging the refrigerant gas G from the compression chamber 43.

That is, since a period in which the refrigerant gas G is discharged and a period in which the refrigerant gas G ceases to be discharged are not alternately repeated in the primary discharge portion 45, a discharge pulsation to be generated in a case where discharge and discharge stop of the refrigerant gas G are alternately repeated in the downstream side of the primary discharge portion 45 is not generated in the compressor 100 according to the present embodiment.

Figure 3:
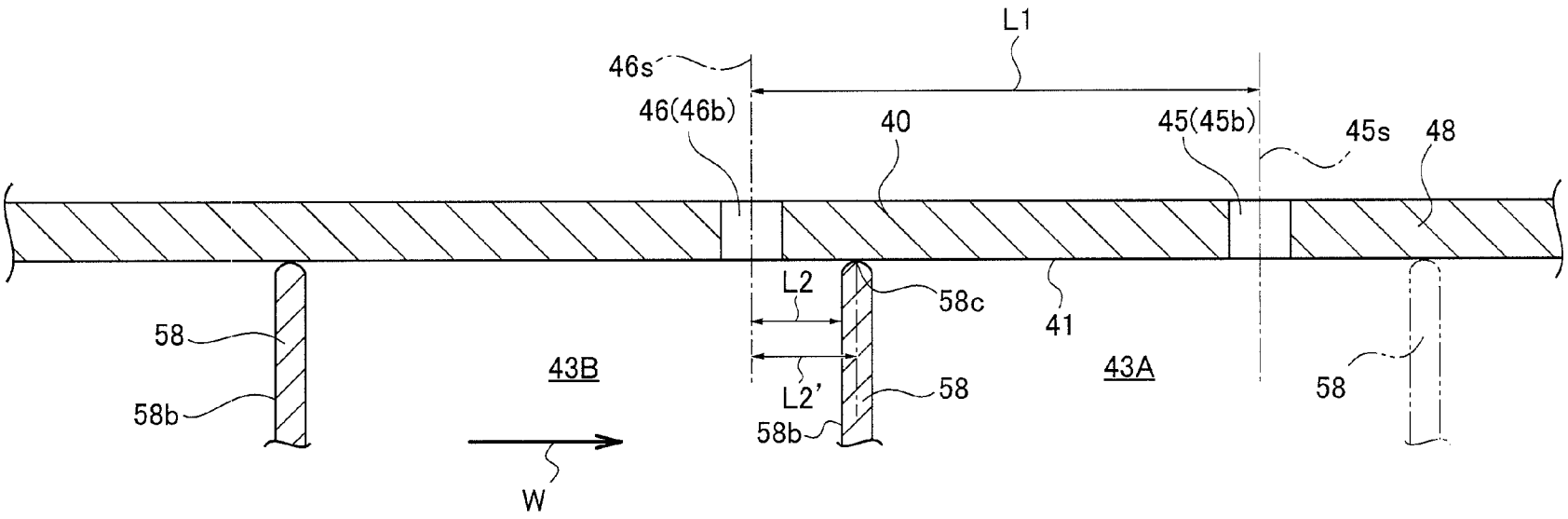
FIG. 3 is a diagram showing a positional relation of a primary discharge portion, a secondary discharge portion and vanes in the compressor of the embodiment.

Here, a specific example where the pressure of the refrigerant gas G inside the compression chamber 43 reaches the discharge pressure in a point before the compression chamber 43 is exposed to the discharge hole 45*b* of the primary discharge portion 45 is, as shown in FIG. 3, configured such that, when an interval from the discharge hole 46*b* of the secondary discharge portion 46 to the discharge hole 45*b* of the primary discharge portion 45 along the inner peripheral surface 41 of the cylinder 40 is indicated at L1, and when the pressure of the refrigerant gas G inside the compression chamber 43B where the vane 58 in the downstream side of the rotational direction W is arranged in a position between the discharge hole 45*b* of the primary discharge portion 45 and the discharge hole 46*b* of the secondary discharge portion 46 reaches the discharge pressure, an interval between the downstream vane 58 and the discharge hole 46*b* of the secondary discharge portion 46 along the inner peripheral surface 41 of the cylinder 40 is indicated at L2, the discharge hole 46*b* of the secondary discharge portion 46 may be formed in a position where the following formula (1) is established.

$$L2<L1 \quad (1)$$

It should be noted that an interval L2 between a surface 58*b* (rear surface 58*b*) directed to the compression chamber 43B, of the vane 58 and a center 46*s* of the discharge hole 46*b* shown in FIG. 3 or an interval L2' between a surface 58*c* making contact with the inner peripheral surface 41 of the cylinder 40, of the vane 58 and the center 46*s* of the discharge hole 46*b* may be applied as the interval between the downstream vane 58 and the discharge hole 46*b* of the secondary discharge portion 46 along the inner peripheral surface 41 of the cylinder 40 when the pressure of the refrigerant gas G inside the compression chamber 43B reaches the discharge pressure.

The interval L1 along the inner peripheral surface 41 of the cylinder 40 from the discharge hole 46*b* of the secondary discharge portion 46 to the discharge hole 45*b* of the primary discharge portion 45 is shown as the interval between the center 46*s* of the discharge hole 46*b* and the center 45*s* of the discharge hole 45*b* in FIG. 3, but may be shown as an interval between edges of the respective discharge holes 45*b*, 46*b* in the downstream side in the rotational direction W or in reverse, an interval between edges of the respective discharge holes 45*b*, 46*b* in the upstream side in the rotational direction W.

According to the compressor 100 in which the discharge hole 46*b* of the secondary discharge portion 46 is formed in such a manner as to establish the above formula (1), the pressure of the refrigerant gas G inside the compression chamber 43B can certainly reach the discharge pressure or more before the vane 58 in the downstream side in the rotational direction W reaches the discharge hole 45*b* of the primary discharge portion 45, that is, before the compression chamber 43B in which the downstream side in the rotational direction W is partitioned by the vane 58 is exposed to the discharge hole 45*b* of the primary discharge portion 45. When the rotor rotates until a point where the compression chamber 43B is exposed to the discharge hole 45*b* of the primary discharge portion 45, the refrigerant gas G can be discharged from the compression chamber 43B to the discharge chamber 45*a* of the primary discharge portion 45 without interruption.

It should be noted that FIG. 3 illustrates the inner peripheral surface 41 of the cylinder 40 in a plane shape, and illustrates a postural and positional relation where the respective vanes 58 are perpendicular to the inner peripheral surface 41 and are in parallel with each other. This diametrical description is conveniently made for easy understanding of the positional relation between the discharge holes 45*b*, 46*b* of the respective discharge portions 45, 46 and the compression chamber 43, and FIG. 3 diametrically illustrated does not cause an inconsistency with the explanation in the embodiment where the outline shape of the inner peripheral surface 41 of the cylinder 40 is formed of a curved line, and each vane 58 is in contact with the inner peripheral surface 41 at an inclined angle other than 90 degrees.

It should be noted that, according to the compressor 100 in the present embodiment, since suction, compression and discharge of the refrigerant gas G are performed by only one cycle for the period of one rotation of the rotor 50, the refrigerant gas G can be more gradually compressed as compared to a compressor that performs two cycles of suction, compression and discharge of the refrigerant gas G for the period of one rotation of the rotor 50. Therefore, necessary power can be reduced, and a difference in pressure between the adjacent compression chambers 43, 43 in tandem in the rotational direction is made small, thus making it possible to suppress a reduction in efficiency due to leakage of the refrigerant gas G into the compression chamber 43 adjacent in the upstream side of the rotational direction from a minute gap between the vane 58 and the side blocks 20, 30.

In addition, since the proximal portion 48 of the inner peripheral surface 41 of the cylinder 40 is formed in a position away, by an angle of 270 degrees or more, from the remote portion 49 in the downstream side along the rotational direction W of the rotor 50, it is possible to more gradually compress the refrigerant gas G than in the gas compressor having the inner peripheral surface 41 in the outline shape in which the proximal portion 48 is formed in a position away, by an angle of about 180 degrees, from the remote portion 49, to further reduce the degree of efficiency degradation.

In the compressor 100 according to the present embodiment, an entire opening area of the discharge hole 45*b* of the primary discharge portion 45 is set to be equal to an entire opening area of the discharge hole 46*b* of the secondary discharge portion 46, but the gas compressor according to the present invention is not limited to a compressor in which two discharge portions (discharge holes) each have the same opening area, but one of the discharge portions (discharge holes) may be formed to be larger in an opening area than the other.

In view of suppressing the influence of the refrigerant gas G accumulated in the dead volume in the secondary discharge portion 46 (discharge hole 46*b*) on the upstream compression chamber in the rotational direction W, it is preferable to set the opening area of the secondary discharge portion 46 (discharge hole 46*b*) to be smaller than the opening area of the primary discharge portion 45 (discharge hole 45*b*).

Each of the discharge holes 45*b*, 46*b* of the primary discharge portion 45 and the secondary discharge portion 46 in the compressor 100 of the aforementioned embodiment may have an opening of the inner peripheral surface 41 of the cylinder 40 formed in any shape including a circular shape or rectangular shape. However, a shape of each of the discharge holes 45*b*, 46*b* of the respective discharge portions 45, 46 is preferably circular in view of easiness of workability.

It should be noted that, in the compressor 100 according to the present embodiment, only one secondary discharge portion 46 is provided in the upstream side in the rotational direction W of the rotor 50 to the primary discharge portion 45, but the gas compressor according to the present invention is not limited to this configuration, but another secondary discharge portion may be provided further to the secondary discharge portion 46 in the upstream side in the rotational direction W of the rotor 50.

In the compressor 100 according to the aforementioned embodiment, the explanation is made of the five vanes 58, but the gas compressor according to the present invention is not limited to this configuration, and the number of the vanes may be optionally two, three, four, six or the like as needed, and the gas compressor having such an optional number of the vanes can also obtain operational effects similar to those of the compressor 100 in the aforementioned embodiment.

REFERENCE SIGNS LIST

10: Housing
11: Body case
12: Front cover
30: Rear side block
40: Cylinder
41: Inner peripheral surface
43, 43A, 43B: Compression chamber
45: Primary discharge portion (discharge portion)
45*b*: discharge hole
46: Secondary discharge portion
50: Rotor
51: Rotary shaft
60: Compressor body
70: Cyclone block
100: Electric vane rotary compressor (Gas compressor)
G: Refrigerant gas (gas)
R: Refrigerant oil
W: Rotational direction

The invention claimed is:

1. A gas compressor that accommodates a compressor body inside a housing, the compressor body comprising:

a substantially columnar rotor that rotates integrally with a rotary shaft;

a cylinder that has an inner peripheral surface of an outline shape for surrounding the rotor from an outside of an outer peripheral surface of the rotor, and is provided with a primary discharge portion for, when a pressure of gas inside a compression chamber exposed to the inner peripheral surface reaches a discharge pressure, discharging the gas inside the compression chamber;

a plurality of plate-shaped vanes provided to project toward the inner peripheral surface of the cylinder from the outer peripheral surface of the rotor; and two side blocks that close both ends of the rotor and the cylinder, wherein the vanes partition a space formed between the inner peripheral surface of the cylinder and the outer peripheral surface of the rotor to form a plurality of compression chambers;

wherein the outline shape of the inner peripheral surface of the cylinder is set such that each compression chamber performs suction and compression of the gas, and discharge of the gas from the primary discharge portion by only one cycle during a period of one rotation of the rotor, wherein a proximal portion in which the inner peripheral surface of the cylinder and the outer peripheral surface of the rotor are the closest is formed in a position downstream along a rotational direction of the rotor and away from a position opposed across a rotational center of the rotor to a remote portion in which the inner peripheral surface of the cylinder and the outer peripheral surface of the rotor are the furthest apart and a pressure of the gas inside the compression chamber is configured to reach the discharge pressure in a point before the compression chamber is exposed to the primary discharge portion;

wherein at least one secondary discharge portion is formed in an upstream side of the primary discharge portion in the rotational direction of the rotor and is configured to discharge the gas inside the compression chamber when the pressure of the gas inside the compression chamber reaches the discharge pressure, and wherein, in a state where the compression chamber is exposed to the primary discharge portion, the primary discharge portion is configured to always discharge the gas from the compression chamber.

2. The gas compressor according to claim 1, wherein the primary discharge portion includes:

a discharge space into which a gas flows;

a discharge hole that provides communication between the discharge space and the compression chamber; and a discharge valve for, when the pressure of the gas inside the compression chamber is equal to or more than the discharge pressure, opening the discharge hole, and when the pressure of the gas inside the compression chamber is less than the discharge pressure, closing the discharge hole.

3. The gas compressor according to claim 2, wherein when an interval from the at least one secondary discharge portion to the primary discharge portion along the inner peripheral surface of the cylinder is defined as L1, and when the pressure of the gas inside the compression chamber where the vane one of the vanes in a downstream side of the rotational direction of the rotor is arranged in a position between the primary discharge portion and the at least one secondary discharge portion reaches the discharge pressure, an interval between the one of the vanes and the at least one secondary discharge portion along the inner peripheral surface of the cylinder is defined as L2, and the secondary discharge portion is formed such that L2<L1.

4. The gas compressor according to claim 2, wherein the proximal portion is formed in a position away, by an angle of 270 degrees or more toward a downstream side in the rotational direction of the rotor from the remote portion.

5. The gas compressor according to claim 1, wherein when an interval from the at least one secondary discharge portion to the primary discharge portion along the inner peripheral surface of the cylinder is defined as L1, and when the pressure of the gas inside the compression chamber where one of the vanes in a downstream side of the rotational direction of the rotor is arranged in a position between the primary discharge portion and the at least one secondary discharge portion reaches the discharge pressure, an interval between the one of the vanes and the at least one secondary discharge portion along the inner peripheral surface of the cylinder is defined as L2, and the secondary discharge portion is formed such that L2<L1.

6. The gas compressor according to claim 5, wherein the proximal portion is formed in a position away, by an angle of 270 degrees or more toward the downstream side in the rotational direction of the rotor, from the remote portion.

7. The gas compressor according to claim 1, wherein the proximal portion is formed in a position away, by an angle of 270 degrees or more toward a downstream side in the rotational direction of the rotor, from the remote portion.

8. The gas compressor according to claim 1, wherein the outline shape of the inner peripheral surface of the cylinder is asymmetric.

* * * * *